US007018970B2

(12) United States Patent
Hsu et al.

(10) Patent No.: US 7,018,970 B2
(45) **Date of Patent: *Mar. 28, 2006**

(54) PROCESS OF MAKING FATTY ALCOHOL BASED GEL DETERGENT COMPOSITIONS

(75) Inventors: Feng-Lung Gordon Hsu, Tenafly, NJ (US); Yun-Peng Zhu, Fairlawn, NJ (US); Charles Ebert, Dumont, NJ (US); Agnes Boudou, Port Sunlight (FR); Ronald Frederick Vogel, New York, NY (US); John David Hines, Moreton (GB)

(73) Assignee: Unilever Home and Personal Care USA division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/694,980

(22) Filed: Oct. 28, 2003

(65) Prior Publication Data

US 2005/0090412 A1 Apr. 28, 2005

(51) Int. Cl.
*C11D 17/00* (2006.01)

(52) U.S. Cl. ..... 510/421; 510/407; 510/417; 510/424; 510/426; 510/505

(58) Field of Classification Search ..... 510/421, 510/424, 426, 417, 407, 505
See application file for complete search history.

(56) References Cited

U.S. PATENT DOCUMENTS

| | | | | |
|---|---|---|---|---|
| 4,515,704 | A | 5/1985 | Akred et al. | 252/135 |
| 4,900,469 | A | 2/1990 | Farr et al. | 252/96 |
| 5,538,662 | A | 7/1996 | Klier et al. | 252/122 |
| 5,820,695 | A | 10/1998 | Lance-Gomez et al. | 134/42 |
| 5,952,285 | A | 9/1999 | Hawkins | 510/405 |
| 5,952,286 | A | 9/1999 | Puvvada et al. | 510/417 |
| 6,794,348 | B1 * | 9/2004 | Hsu et al. | 510/280 |
| 6,815,409 | B1 * | 11/2004 | Hsu et al. | 510/280 |

FOREIGN PATENT DOCUMENTS

| | | |
|---|---|---|
| EP | 839 898 | 5/1998 |
| GB | 2 355 015 | 4/2001 |
| WO | 99/06519 | 2/1999 |
| WO | 99/27065 | 6/1999 |
| WO | 02/20706 | 3/2002 |

OTHER PUBLICATIONS

Co-pending Application: Applicant: Zhu et al., C6638(V); Filed: Sep. 20, 2002 10/251738.
Co-pending Application: Applicant: Hsu et al., C6639(V); Filed: Sep. 20, 2002 10/251481.
Co-pending Application: Applicant: Hsu et al., C6640(V); Filed: Sep. 20, 2002 10/251458.
Co-pending Application: Applicant: Hsu et al., C6641(V); Filed: Sep. 20, 2002 10/247957.
PCT International Search Report in a PCT application PCT/EP 2004/011367.

* cited by examiner

*Primary Examiner*—Necholus Ogden
(74) *Attorney, Agent, or Firm*—Rimma Mitelman

(57) ABSTRACT

According to the inventive method of making gels, the main mixture comprising most of the ingredients with the exception of a fatty alcohol is mixed, using at least one in-line mixer, with the gelling post-mix comprising the fatty alcohol. The preferred process includes the mixing of the main mixture and the gelling post-mix just prior to either filling or storing the composition.

5 Claims, No Drawings

PROCESS OF MAKING FATTY ALCOHOL BASED GEL DETERGENT COMPOSITIONS

FIELD OF THE INVENTION

The invention relates to a process of making gel compositions.

BACKGROUND OF THE INVENTION

Thickened or gel laundry products are preferred by many consumers, over either powder or liquid detergents. Gels provide the advantages of liquid detergents, but also can be used for pretreatment of fabrics, obviating the necessity for purchase of a separate pre-treatment product.

Gel detergents have been described. See, for instance, WO 99/06519 and WO 99/27065, Klier et al. (U.S. Pat. No. 5,538,662), GB 2 355 015, Lance-Gomez et al. (U.S. Pat. No. 5,820,695), Hawkins (U.S. Pat. No. 5,952,285), Akred et al. (U.S. Pat. No. 4,515,704), Farr et al. (U.S. Pat. No. 4,900,469).

When a gel is made in a typical thin liquid mixer (i.e., a tank mixer) its shear-thinning characteristic does not allow for homogeneous mixing. The high shear portions of the mixer thin out the gel and are highly mixed areas. The low shear areas barely move—the gel thus creating a disproportionate mixture as ingredients are added. The mixture is made even more disproportionate by the typical method of ingredient addition, e.g. from dilute to rich. The disproportion causes areas of the gel mixture to rise high in viscosity (lumps), thus creating extended and unknown mix times. These typical liquid mixers, their methods of use and the additional mixing needed in them results in entraining air in the gel that cannot or easily be removed. Similar problems exist post mixing. Since the gel is high viscosity at low shear conditions, it is difficult to prime a pump—thus, typical liquid pumps cannot be used. There is also a greater chance of aeration when pumping and moving the gel because of its physical characteristics. Furthermore, if other minor ingredients are post dosed into the gel, extreme methods and/or large amounts of time are required to make a uniform product, due to the gel being shear-thinning. The gel is also harder to clean off the process equipment—thus, increased cleaning times and ingredients needed. Making the gel by using a tank mixer designed for use with liquids still involves a myriad of manufacturing issues dealing with post dosing, pumping, storing and aeration.

SUMMARY OF THE INVENTION

The present invention includes a process of making a gel detergent composition, the process comprising mixing ingredients comprising preparing a main mixture and a gelling post-mix, which comprise in total:

(a) from about 8% to about 35%, by weight of the composition, of a surfactant, selected from the group consisting of anionic, nonionic cationic, amphoteric surfactants and mixtures thereof;

(b) from about 0.1% to about 5%, by weight of the composition; of a fatty alcohol;

(c) from about 50 to about 90% of water;

wherein (i) the mixing is carried out in at least one in-line static or dynamic mixer; and (ii) the gelling post-mix constitutes from about 1% to about 30% of the composition and comprises the fatty alcohol and optionally a nonionic surfactant.

Surprisingly, it has been discovered, as part of the present invention, that by employing the gelling post-mix and by mixing in an in-line mixer, the inventive process results in a better-mixed gel and a more economical process.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the gel detergent composition, unless otherwise specified.

It should be noted that in specifying any range of concentration, any particular upper concentration can be associated with any particular lower concentration.

For the avoidance of doubt the word "comprising" is intended to mean "including" but not necessarily "consisting of" or "composed of." In other words, the listed steps or options need not be exhaustive.

"Gel" as used herein means a shear thinning, lamellar gel, with a pouring viscosity in the range of from 100 to 5,000 mPas (milli Pascal seconds), more preferably less than 3,000 mPas, most preferably less than 1,500 mPas. The concept of "gel" in the art is frequently not well defined. The most common, loose definition, however, is that a gel is a thick liquid. Nevertheless, a thick liquid may be a Newtonian fluid, which does not change its viscosity with the change in flow condition, such as honey or syrup. This type of thick liquid is very difficult and messy to dispense. A different type of liquid gel is shear-thinning, i.e. it is thick at low shear condition (e.g., at rest) and thin at high flow rate condition. The rheology of shear-thinning gel may be characterized by Sisko model:

$$\eta = a + b \times \dot{\gamma}^{n-1}.$$

Where $\eta$ is Viscosity, mPA s, $\dot{\gamma}$ is shear rate, 1/sec, a, b are constants, and $\eta$ is Sisko Rate index.

As used herein, "Shear-thining" means a gel with the Sisco rate index less than 0.6.

Shear-thinning Theological properties can be measured with a viscometer or a sophisticated rheometer and the correct measurement spindle. The selection of spindle depends on the type of instrument. Generally, a cylindrical spindle needs a greater volume of sample; less sample is needed for either the disc or cone shape spindles. The protocol involves a steady state flow (SSF). The first step is conditioning step that pre-shears the sample at a set temperature (e.g. 25° C.). The time requirement depends on the type of sample: it generally takes from 30 seconds to an hour. The second step is the steady state flow step, which involves adjusting either shear stress (for a controlled stress rheometer only) or shear rate and collecting data after the sample has reached apparent equilibrium. To determine the flow behavior, the maximum shear rate and the ramp time can be arbitrarily chosen for the test program. During the test, up to 1000 data points can be gathered and the viscosity, shear stress, shear rate, temperature and test time at each point are stored. The plot of viscosity vs. shear rate will reveal whether the sample is shear thinning or not. A mathematical model, such as Sisko model, may be fitted to the data points.

As used herein, "pouring viscosity" means viscosity measured at a shear rate of 21 $s^{-1}$, which can be measured using the procedure described immediately above, or it can be read off the plot of viscosity vs. shear rate.

As used herein, "lamellar" means that liquid crystals within the gel have lipid layers (sheets). Lamellar structures can be detected by polarized light microscope.

As used herein, "lamellar gels" means gels that have a lamellar phase structure, in which the volume of lamellar phase (known as Lα) is not less than 80% of the total volume of product, the remainder consisting of material in the isotropic or L1 phase. Preferably, the volume of Lα phase should be close to or at 100%.

A sophisticated rheometer, such as AR-series from TA Instruments is needed for the measurement of G' and G". First, the Pseudo-linear viscoelastic region (LVR) is determined via an Osillatory Stress Sweep (OSS). The sample is then conditioned via timed pre-shear at a set temperature (e.g. 25° C.) so that its structure can equilibrate and so that the geometry to come to thermal equilibration before data acquisition begins. Next, a Stress Sweep step is performed. For an unknown sample, a good rule of thumb is to test over the allowable shear stress (torque) range of the instrument (e.g. 1–10,000 microN.m) and a frequency of 1 Hz. Finally, an Oscillatory Frequency Sweep is performed. The frequency range may be set between 100 Hz to 0.1 Hz. The % Strain or shear stress should be set to a value within LVR found the OSS step. The G' value from LVR is used to correlate to the Snap-Back phenomenon.

"Transparent" as used herein includes both transparent and translucent and means that an ingredient, or a mixture, or a phase, or a composition, or a package according to the invention preferably has a transmittance of more than 25%, more preferably more than 30%, most preferably more than 40%, optimally more than 50% in the visible part of the spectrum (approx. 410–800 nm). Alternatively, absorbency may be measured as less than 0.6 (approximately equivalent to 25% transmitting) or by having transmittance greater than 25% wherein % transmittance equals: $1/10^{absorbancy} \times 100\%$. For purposes of the invention, as long as one wavelength in the visible light range has greater than 25% transmittance, it is considered to be transparent/translucent.

"Gel" as used herein also means a non-pourable lamellar thick gel.

Process of Making Composition

According to the inventive method of making the compositions, the main mixture comprising most of the ingredients with the exception of a fatty alcohol is mixed with the gelling post-mix comprising the fatty alcohol.

The inventive process employs an in-line static or dynamic mixer.

Static Mixers

Static Mixers are in-line units with no moving parts. The mixer is constructed of a series of stationary, rigid elements that form intersecting channels to split, rearrange and combine component streams resulting in one homogeneous stream. Static mixers provide simple and efficient solutions to mixing and contacting problems. More affordable than dynamic agitator systems, static mixing units have a long life with minimal maintenance and low pressure drop. Static mixers are fabricated from most metals and plastics to fit pipes and vessels of virtually any size and shape.

Koch engineering for example has the following models and types that can be utilized, such as SMV turbulent flow static mixers, SMX laminar flow static mixer, SMXL heat transfer enhancement static mixer, SMF static mixer, SMVP plug flow reactor mixer. Preferred in-line mixer is the SMX laminar flow static mixer due to its higher shear conditions—thus, fewer mixing elements or shorter length time is possible.

Dynamic Mixer

Any device that imparts shear on the liquid as the gel forms can be utilized as a dynamic mixer. This includes gear pumps, colloid mills, homogenisers, and other such devices.

In the preferred embodiment of the inventive process, the gelling of the composition is delayed until the last step, thus simplifying manufacturing and ensuring the best mixing of the ingredients. Most preferably, the gelling post-mix is added last to the main mixture comprising the rest of the ingredients, just before the pumping to the filling station. In the preferred process at least 2 in-line mixers are used sequentially, to increase the number of mixing elements.

A preferred optional ingredient in the gelling post-mix is a non-ionic surfactant, to improve process control or give a better mixed surfactant structure. A further preferred optional ingredient in the gelling post-mix is an antioxidant.

The surfactants may be split in any ratio between the main-mix and post-mix.

It is preferred to have all the anionic surfactant acids in the main-mix for the simplification of supply chain logistics. However, the anionic surfactant acid may be split in any ratio between the main-mix and post-mix. Some of the acid may be used in the main-mix or post-mix to control the pH; it is preferred to keep the main-mix pH below 8.0 so as to minimize degradation of certain ingredients (e.g. preservatives or enzymes). To improve the efficiency of preparing the main mix, it is beneficial to prepare a pre-mix separately and mix in with the main mix at a later stage to finish the final main mix preparation (see Examples 4 and 5).

The post-mix comprises from 1 to 30%, by weight of the total composition preferably from 3 to 25%, most preferably from 4 to 15%.

Preferably, the mixing of the two mixtures is done just before the pumping to the filling station, or just before bottling, or just before storage. Due to the organic nature of fatty alcohol, other ingredients that may optionally be used to form a post mix are selected from other organic ingredients, such as non-ionic surfactant, solvent, and anionic surfactant precursors, e.g. fatty acid and LAS acid.

Detergent Surfactant

The compositions of the invention contain one or more surface active agents selected from the group consisting of anionic, nonionic, cationic, amphoteric and zwitterionic surfactants or mixtures thereof. The preferred surfactant detergents for use in the present invention are mixtures of anionic and nonionic surfactants although it is to be understood that anionic surfactant may be used alone or in combination with any other surfactant or surfactants. Detergent surfactants are typically oil-in-water emulsifiers having an HLB above 10, typically 12 and above. Detergent surfactants are included in the present invention for both the detergency and to create an emulsion with a continuous aqueous phase.

Anionic Surfactant Detergents

Anionic surface active agents which may be used in the present invention are those surface active compounds which contain a long chain hydrocarbon hydrophobic group in their molecular structure and a hydrophilic group, i.e. water solubilizing group such as carboxylate, sulfonate or sulfate group or their corresponding acid form. The anionic surface active agents include the alkali metal (e.g. sodium and potassium) water soluble higher alkyl aryl sulfonates, alkyl sulfonates, alkyl sulfates and the alkyl poly ether sulfates.

Anionic surfactants may, and preferably do, also include fatty acid soaps—i.e., fully neutralized fatty acids.

One of the preferred groups of anionic surface active agents are the alkali metal, ammonium or alkanolamine salts of higher alkyl aryl sulfonates and alkali metal, ammonium or alkanolamine salts of higher alkyl sulfates. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates. Also normal alkyl and branched chain alkyl sulfates (e.g., primary alkyl sulfates) may be used as the anionic component.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R_1—O(CH_2CH_2O)_p—SO_3M,$$

where $R_1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

It should be noted that linear ethoxy sulfates (LES) acid is not stable. Accordingly, when LES is employed, it is pre-neutralized and used as 70% active paste, without hydrotrope, and is diluted during the processing.

The detergent compositions of the present invention are laundry compositions and consequently, preferably include at least 2% of an anionic surfactant, to provide detergency and foaming. Generally, the amount of the anionic surfactant is in the range of from 3% to 35%, preferably from 5% to 30% to accommodate the co-inclusion of nonionic surfactants, more preferably from 6% to 20% and, optimally, from 8% to 18%.

The anionic surfactant may be, and preferably is, produced (neutralized) in situ, to minimize processing cost, by neutralization of the precursor anionic acid (e,g. linear alkylbenzene sulfonic acid and/or fatty acid) with a base. Suitable bases include, but are not limited to monoethanolamine, triethanolamine, alkaline metal base, and preferably is sodium hydroxide and monoethanalamine mixture, because sodium hydroxide is the most economic base source and monoethanolamine offers better pH control.

Nonionic Surfactant

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature).

Usually, the nonionic surfactants are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 5 to 20. Of such materials it is preferred to employ those wherein the alkanol is a fatty alcohol of 9 to 11 or 12 to 15 carbon atoms and which contain from 5 to 8 or 5 to 9 alkoxy groups per mole. Also preferred is paraffin —based alcohol (e.g. nonionics from Huntsman or Sassol).

Exemplary of such compounds are those wherein the alkanol is of 10 to 15 carbon atoms and which contain about 5 to 12 ethylene oxide groups per mole, e.g. Neodol® 25-9 and Neodol® 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac® by BASF. The Plurafac® are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodo® trademark: Dobanol® 91-5 is an ethoxylated $C_9$–$C_{11}$ fatty alcohol with an average of 5 moles ethylene oxide and Dobanol® 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols or alyl phenols with relatively narrow contents of ethylene oxide in the range of from about 6 to 11 moles, and the $C_9$ to $C_{11}$ fatty alcohols ethoxylated with about 5–6 moles ethylene oxide.

Another class of nonionic surfactants which can be used in accordance with this invention are glycoside surfactants.

Generally, nonionics would comprise 0–32% by wt., preferably 5 to 30%, more preferably 5 to 25% by wt. of the composition.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Amphoteric synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino) propane-1-sulfonate, sodium 2-(dodecylamino) ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis (2-hydroxyethyl)-2-sulfato-3-dodecoxypropylamine. Sodium 3-(dodecylamino) propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The total amount of surfactant used may vary from 8 to 35%, preferably 10 to 30%, more preferably 12 to 25%.

As noted, the preferred surfactant systems of the invention are mixtures of anionic and nonionic surfactants.

Particularly preferred systems include, for example, mixtures of linear alkyl aryl sulfonates (LAS) and alkoxylated (e.g., ethoxylated) sulfates (LES) with alkoxylated nonionics for example in the ratio of 1:2:1 or 2:1:1.

Preferably, the nonionic should comprise, as a percentage of an anionic/nonionic system, at least 20%, more preferably at least 25%, up to about 75% of the total surfactant system. A particularly preferred surfactant system comprises anionic:nonionic in a ratio of 3:1 to 1:3.

Fatty Alcohol

Any fatty alcohol is suitable, including but not limited to linear, branched or oxo fatty alcohols containing between 8 and 16 carbon atoms, and mixtures thereof, preferably selected from fatty alcohols which would be liquid at room temperature. Naturally obtainable fatty alcohols, which are usually complex mixtures, are also suitable (such as tallow, coconut, and palm kernel derived fatty alcohols. The preferred fatty alcohol is a branched and/or oxo fatty alcohol containing between 10 and 14 carbon atoms because it is liquid at room temperature and this chain length is particularly suitable for inducing lamellar phase; furthermore, these molecules can offer good detergency properties as co-surfactants in the washing process.

The amount of fatty alcohol depends on the amount of surfactant employed. Generally, the amount of fatty alcohol is in the range of from 0.1% to 5%, preferably from 2% to 4% to obtain optimum gels at minimum cost.

Suitable commercially available fatty alcohols for use in the present invention to induce lamellar phase gels include, bu are not limited to Neodol®23 and Neodol®25 supplied by Shell Chemical Co., Exxal®10, Exxal®12 and Exxa®113 supplied by ExxonMobil Chemical Limited, Isalchem®123 supplied by Sasol Chemical Company, 2-Et-HA alcohol from Eastmen Chemical and Guerbet from Sasol.

Water

The inventive compositions generally include water as a solvent and the carrier. Water amount is preferably in the range of from 50 to 90%, more preferably from 55 to 85%, most preferably from 60 to 80%.

Optional Ingredients

A particularly preferred optional ingredient(s) is a pH jump system (e.g., boron compound/polyol), as described in the U.S. Pat. Nos. 5,089,163 and 4,959,179 to Aronson et al., incorporated by reference herein.

Anti-oxidant

A particularly preferred optional ingredient is an anti-oxidant. It has been found that the use of an anti-oxidant in conjunction with un-saturated elements in the formulation, e.g. Oleic acid, may prevent or substantially minimize the discoloration or yellowing of a gel. Suitable anti-oxidants include but are not limited to butylated hydroxytoluene (BHT), TBHQ (tert-butylhydroquinone), propyl gallate, gallic acid, Vitamin C, Vitamin E, Tannic acid, Tinogard, Tocopherol, Trolox, BHA (butylated hydroxyanisole), and other known-anti-oxidant compounds. BHT is preferred. Generally, from 0.0% to about 5.0%, preferably from 0.01% to 1%, more preferably from 0.03% to 0.5% may be employed.

Hydrotrope

Hydrotrope reduces and prevents liquid crystal formation. Generally, it is known that the addition of hydrotrope destroys gels. Surprisingly, it has been discovered that the addition of a low level of hydrotrope aids in the formation of inventive gels, while also improving the clarity/transparency of the composition. Suitable hydrotropes include but are not limited to propylene glycol, glycerine, ethanol, urea, salts of benzene sulphonate, toluene sulphonate, xylene sulphonate or cumene sulphonate. Suitable salts include but are not limited to sodium, potassium, ammonium, monoethanolamine, triethanolamine. Preferably, the hydrotrope is selected from the group consisting of propylene glycol, glyurine xylene sulfonate, ethanol, and urea to provide optimum performance. The amount of the hydrotrope is generally in the range of from 0 to 6%, preferably from 0.1 to 5%, more preferably from 0.2 to 4%, most preferably from 0.5 to 3%. The most preferred hydrotrope is propylene glycol and/or glycerine because of their ability, at a low level, to improve gel quality without destroying the structure.

Colorant

The colorant may be a dye or a pigment. Most preferably, a water-soluble dye (to prevent staining on clothes) is employed. The preferred compositions are blue.

Builders/Electrolytes

Builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts. A preferred electrolyte is borax, because it can be used in a complex form with polyol, which reserves an alkaline source until the composition is diluted. This allows enzymes and other pH sensitive ingredients to be formulated without risk of significant loss. In other, non-enzyme containing formulations, preferred electrolytes include sodium carbonate or sodium silicate.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetatesand N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, imino disuccinate, salts of polymers of itaconic acid and maleic acid, tartrate monosuccinate, tartrate disuccinate and mixtures thereof.

Sodium citrate is particularly preferred, to optimize the function vs. cost, (e.g. from 0 to 15%, preferably from 1 to 10%).

Certain zeolites or aluminosilicates can be used. One such aluminosilicate which is useful in the compositions of the invention is an amorphous water-insoluble hydrated compound of the formula $Na_x[(AlO_2)_y.SiO_2]$, wherein x is a number from 1.0 to 1.2 and y is 1, said amorphous material being further characterized by a Mg++exchange capacity of from about 50 mg eq. $CaCO_3$/g. and a particle diameter of from about 0.01 micron to about 5 microns. This ion exchange builder is more fully described in British Pat. No.1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

The preferred laundry composition may further include one or more well-known laundry ingredients, anti-redeposition agents, fluorescent dyes, perfumes, soil-release polymers, colorant, enzymes, enzyme stabilzation agents (e.g., sorbitol and/or borates), buffering agents, antifoam agents, UV-absorbers, etc.

Optical brighteners for cotton, polyamide and polyester fabrics can be used. Suitable optical brighteners include Tinopal, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicone compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/372 and ultramarine blue can be used.

Also, soil release polymers and cationic softening agents may be used.

The list of optional ingredients above is not intended to be exhaustive and other optional ingredients which may not be listed, but are well known in the art, may also be included in the composition.

The compositions are preferably substantially free (i.e. contain less than 2%, preferably less than 1%, most preferably less than 0.5%) of traditional thickening agents, such as cross-linked polyacrylates, polysaccharide gums such as xantham, gellan, pectin, carrageenan, gelatin.

Use of the Composition

The compositions are used as laundry cleaning products (e.g., a laundry detergent, and/or a laundry pretreater). The inventive product offers an advantage of laundry pre-treater and a detergent in a single product. In use, a measured amount of the composition is deposited on the laundry or in the laundry washing machine, whereupon mixing with water, the cleaning of laundry is effected.

Container

The inventive compositions are opaque or transparent, and are preferably packaged within the transparent/translucent bottles.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

The following specific examples further illustrate the invention, but the invention is not limited thereto.

The following ingredients (abbreviated or listed by trademarks) were used in the Examples:

| Abbreviation/Trademark | Description |
|---|---|
| LAS acid | $C_9$—$C_{13}$ linear Alkylbenzene Sufonic Acid |
| LES (70% active) | 70% aqueous paste of sodium salt of $C_{12}$—$C_{15}$ 3-EO Linear ethoxylated sulfate |
| Neodol ® 23-5 | $C_{12}$—$C_{13}$ 5-EO Ethoxylated fatty alcohol |
| Neodol ® 1-3 | $C_9$—$C_{11}$ 3-EO Ethoxylated fatty alcohol |
| Neodol ® 1-5 | $C_9$—$C_{11}$ 5-EO Ethoxylated fatty alcohol |
| 2-Et-HA alcohol | 2-Ethyl Hexanol |
| Witcamide ® 511 | Fatty alkanolamide |
| Guerbet ® 12T | Butyloctanol |

One or more of inline mixers or dynamic mixers or both types of mixers may be used for the following examples. The inline mixers used in the examples were from Koch engineering, model # 1/2SMX-14–316. Two of the mixers were used individually or in sequence each being 31.8 cm long and 1.57 cm wide static mixers, with 14 elements each. Various dynamic mixers used for these examples were EmulsiFlex—C5 by Avestin, M E 100LC or HSM 400 DL Homogenizer by Ross, F L320 mixer/homogenizer by Silverson, or QCM25 Micro Pump. EmulsiFlex—C5 was used mainly for bench scale examples. ME100LC and QCM25 Micro Pump were used for both bench scale and pilot scale. HSM 400 DL and FL320 Homogenizers were mainly for pilot scale examples.

EXAMPLES 1–3 AND COMPARATIVE EXAMPLE A

All examples were prepared by first adding water into the main mix tank followed by mixing in sodium citrate dehydrate, 50% NaOH solution, monoethanolamine (MEA), borax, propylene glycol and heating the mixture to 30° C. When all the ingredients were dissolved, sulfonic acid and fatty acid were added. Temperature of the mix could raise to about 35° C. due to the neutralization heat. Finally, other ingredients such as F-dye, preservative, perfume, polymers and others were added.

The gelling post-mix was prepared simply by mixing alcohol with nonionic surfactant and fatty acid. The post-mix was maintained at the temperature of the melting point of other ingredients, such as nonionic or fatty acid, in the post-mix for its mobility. The main mix and post-mix were highly mobile liquid. The final stage of preparation was to mix these two relative thin liquids of main mix and post-mix in an EmulsiFlex—C5 at a high shear to form a stable gel.

The formulations of Examples 1–3 and A are summarized in Table 1.

TABLE 1

| | Examples | | | |
|---|---|---|---|---|
| INGREDIENT | 1 % | 2 % | 3 % | A % |
| | Main Mix | | | |
| Water | 65.98 | 65.98 | 63.94 | 63.94 |
| Borax | 3.00 | 3.00 | 3.00 | 3.00 |
| Sodium Citrate | 3.90 | 3.90 | 3.90 | 3.90 |
| NaOH (50%) | 1.11 | 1.11 | 1.11 | 1.11 |
| Monoethanolamine | 2.23 | 2.23 | 2.23 | 2.23 |
| LAS acid | 4.40 | 4.40 | 4.40 | 4.40 |
| Coco Acid | 3.50 | 3.50 | 3.50 | 3.50 |
| F-Dye | 0.10 | 0.10 | 0.10 | 0.10 |
| Miscellaneous | To 100 | To 100 | To 100 | To 100 |

TABLE 1-continued

| INGREDIENT | Examples 1 % | 2 % | 3 % | A % |
|---|---|---|---|---|
| | | Post-mix | | |
| Neodol ® 23-5 | | 9.00 | | |
| Neodol ® 1-5 | 9.00 | | 11.14 | 11.14 |
| Oleic Acid | 5.28 | 5.28 | 5.28 | 5.28 |
| 2-Et-HA alcohol | 1.50 | 1.50 | 1.40 | 0.00 |
| RESULTS | Gel | Gel | Gel | Hazy Liquid* |

*Eventually phase separated in a week.

Examples 1 and 3 were within the scope of the invention (containing fatty alcohol) and were a clear gel. Example A (outside the scope of the invention) did not contain a fatty alcohol and did not form a gel.

EXAMPLES 4 AND 5

Examples 4 and 5 (both within the scope of the invention) demonstrate that the gelling agent, fatty alcohol, may be able to combine with different ingredients to form different low water content post-mix and facilitate the formation of gel. The preparation of main mix, pre-mix and post-mix were following the order of ingredients listed in Table 2. Subsequently, the pre-mix was fully mixed with the main-mix, before the final mixing with the post-mix in an Emulsi-Flex—C5 to form a gel.

TABLE 2

| Component | Examples 4 % | 5 % |
|---|---|---|
| | Main Mix | |
| Water | 65.14 | 65.06 |
| NaOH (50%) | 1.10 | 1.10 |
| Borax | 3.00 | 3.00 |
| Monoethanolamine | 2.22 | 2.30 |
| Sodium Citrate | 3.50 | 3.70 |
| Misc. | To 100 | To 100 |
| | Post-mix | Pre-mix |
| Witcamide ® 511 | 1.00 | 0.00 |
| Neodol ® 1-3 | 5.00 | 5.00 |
| 2-ET HA alcohol | | 1.50 |
| Oleic Acid | 5.28 | 5.28 |
| | Pre-mix | Post-mix |
| Coco Acid | 3.50 | 3.50 |
| LAS acid | 4.40 | 4.40 |
| 2-ET HA alcohol | 0.70 | |
| RESULTS | stable gel, slightly opaque | stable gel, almost translucent |

EXAMPLES 6–10

Examples 6–10 were structured by either Neodol®91, Neodol®23 or Guerbet®-12T at a bench scale. The preparation procedure for the main-mix and post-mix followed the order of ingredients listed in Table 3. Both the main mix and the post-mix were thin and mobile. A stable gel was obtained after combing both liquids by a Koch 1/2S Mx-14–316 in-line mixer, followed by a Ross ME 100LC Homogenizer.

TABLE 3

| INGREDIENT | EXAMPLES 6 % | 7 % | 8 % | 9 % | 10 % |
|---|---|---|---|---|---|
| | | Main Mix | | | |
| DI Water | 39.93 | 66.04 | 57.48 | 57.98 | 59.48 |
| Sorbitol (70%) | 3.79 | | | | |
| Sodium Citrate | 3.00 | 3.50 | 3.90 | 3.90 | 3.90 |
| Propylene Glycol | 6.50 | 2.0 | 8.00 | 8.00 | 8.00 |
| Boric acid | 1.00 | | | | |
| Borax | | 3.00 | 3.00 | 3.00 | 3.00 |
| NaOH (50%) | 1.29 | 1.10 | 1.11 | 1.11 | 1.11 |
| LES (70%) | 11.43 | | | | |
| NaOH (50%) | 2.08 | | | | |
| Monoethanolamine | 1.81 | 2.22 | 2.23 | 2.23 | 2.23 |
| LAS acid | 8.38 | 4.20 | 4.40 | 4.40 | 4.40 |
| Oleic Fatty Acid | 8.00 | | | | |
| Coco Fatty acid | | 3.50 | 3.50 | 3.50 | 3.50 |
| Neodol ® 25-9 | 8.00 | | | | |
| Misc | To 100 | To 100 | To 100 | To 100 | To 100 |
| | | Post-mix | | | |
| Witcamide ® 511 | | 1.50 | | | |
| Neodol ® 25-9 | | | 7.00 | 5.00 | 7.00 |
| Neodol ® 25-7 | | | | | 5.00 |
| Neodol ® 91 | | | | | 2.00 |
| Neodol ® 23 | | 2.50 | 4.00 | 3.50 | |
| Oleic acid | | 5.28 | 5.28 | 5.28 | 5.28 |
| Guerbet ®-12T | 3.10 | | | | |
| glycerine | 1.00 | | | | |
| RESULTS | Gel | Gel | Gel | Gel | Gel |

EXAMPLES 11–14

Examples 11–14 illustrate the methods of the present invention of manufacture at a pilot scale. The main mixes were prepared by mixing water, 70% sorbitol solution, propylene glycol, 50% sodium hydroxide solution, and borax. After borax was dissolved under moderate agitation, LAS acid, coconut fatty acid and Neodol® 25-9 were added to the main mix. The remainder of the minor ingredients were then added under moderate agitation. Post-mix for examples 12, 13 and 14 were then prepared by mixing a fatty alcohol and Neodol® 25-9. In Example 11, post-mix contained only fatty alcohol.

The gel was formed by co-mingling the post-mix with the main mix in the proportions as stated in the formula, just before bottling the product to avoid gel handling issues. This was accomplished while pumping it to a filling machine, while in the filling machine or in the process of filling the bottles. For the gel to form efficiently, effectively and properly intimate interaction of constituents was needed. To achieve this, an in-line static mixer was utilized. The two mixes were metered through pipelines to a point where the two premixes were co-mingled at the correct formula proportions. The mixture at this point was then pushed through the mixing device, a static mixer. The components were in intimate contact and began to form the gel. At the exit of the mixing device the product was then mixed and sheared by a in-line dynamic mixing device. After passing through this type of mixer the gel was fully formed and ready be packed or stored.

The process of making the gel in this manner greatly reduces process cycle time. The only time required was for making the two premixes and pumping the two premixes through a short length of process pipe and associated equipment. By using this process, gel handling issues, cycle time, gel variability and manufacturing difficulties were greatly reduced. A 250-kg batch for this process was about two hours.

TABLE 4

| Ingredients | Example 11 % | 12 % | 13 % | 14 % |
|---|---|---|---|---|
| **Main Mix** | | | | |
| LAS acid | 6.0 | 6.0 | 6.0 | 6.0 |
| Neodol 25-9 | 6.0 | 6.0 | 3.4 | 4.9 |
| Coconut Fatty Acid | | 3.0 | 3.0 | 3.0 |
| Sorbitol, 70% active | 6.9 | 6.9 | 3.5 | 6.9 |
| Borax | 2.3 | 2.3 | 2.3 | 2.3 |
| NaOH, 50% active | 1.5 | 1.5 | 1.5 | 1.5 |
| Monoethanolamine | | 0.9 | 0.9 | 0.9 |
| Propylene Glycol | 0.5 | 0.5 | 4.0 | 0.5 |
| Water | 72.8 | 63.5 | 69.9 | 68.5 |
| Miscellaneous | To 100 | To 100 | To 100 | To 100 |
| Main Mix Appearance | Thin Clear liquid | Thin Hazy liquid | Thin Hazy liquid | Thin Hazy liquid |
| **Post-mix** | | | | |
| Neodol ® 23 | 3.0 | 6.0 | 3.0 | 3.0 |
| Neodol ® 25-9 | | 2.0 | 1.12 | 1.12 |
| Post-mix Appearance | Thin Clear liquid | Thin Clear liquid | Thin Clear liquid | Thin Clear liquid |
| **Final Product after Process** | | | | |
| Characteristics | Clear Gel | Clear Gel | Clear Gel | Clear Gel |
| pH | 7.4 | 7.2 | 7.2 | 7.3 |

COMPARATIVE EXAMPLES B, C, D, E

Comparative examples B, C, D, and E demonstrate the failure of a conventional batch process in preparing a stable gel at temperature less than 45° C. In addition, the examples also show that the excess time and energy are needed in comparison to Examples 11–14. A 200-liter batch tank with a 1:1 ratio of working height to diameter was used as a batch tank. A variable speed agitator equipped with two sets of paddles pitched at 45° was used to stir the tank. Examples B, C, D and E were prepared by first mixing water, 70% sorbitol solution, propylene glycol, non-ionic surfactant, 50% sodium hydroxide solution, monoethanolamine (if required) and borax in the batch tank. After borax was dissolved under moderate agitation, LAS acid and coconut fatty acid (if the latter was an ingredient in the formulation) were added to the main mix. The fatty alcohol was then added to the mixture. When the fatty alcohol was added to the batch tank, the gel began to form at any point of contact. As the gel formed the mixture increased in viscosity but at the same time became shear thinning. The tank walls became coated with thick gel while the areas around the agitator thinned out and became highly mixed. To sufficiently disperse all of the raw materials so that there was enough interactions for the gel to form, a significant amount of additional mixing, energy or mechanical action was required. The additional batch time and energy required depended upon the formulation type and bath size used but in all the cases more than several hours were needed to form a gel product. For a 200-Kg batch, the total batch time was about 7½ hours. Examples B and C were hazy, lumpy and not homogeneous. Examples D and E were hazy, thick liquids. After six weeks of storage, all four examples were phase separated. The separation may be due to the inhomogeneous nature of these samples. The compositions and results are summarized in Table 5.

TABLE 5

| Ingredients | Example B % | C % | D % | E % |
|---|---|---|---|---|
| **Main Mix** | | | | |
| Linear Alkyl Benzene Sulphonic acid | 6.0 | 6.0 | 6.0 | 6.0 |
| Non-ionic (C12–C14, 9 EO) | 6.0 | 8.0 | 4.5 | 6.0 |
| C12–13 Alcohol (Fatty Alcohol) | 3.0 | 6.0 | 3.0 | 3.0 |
| Coconut Fatty Acid | | 3.0 | 3.0 | 3.0 |
| Sorbitol | 6.9 | 6.9 | 3.5 | 6.9 |
| Borax | 2.3 | 2.3 | 2.3 | 2.3 |
| NaOH | 1.5 | 1.5 | 1.5 | 1.5 |
| Mono-ethanolamine | | 0.9 | 0.9 | 0.9 |
| Propylene Glycol | 0.5 | 0.5 | 4.0 | 0.5 |
| Water | 72.8 | 63.5 | 69.9 | 68.5 |
| Miscellaneous | To 100 | To 100 | To 100 | To 100 |
| **Final Product after Process** | | | | |
| Characteristics | Hazy lumpy Gel; Phase Separated | Hazy lumpy gel; Phase Separated | Hazy; Phase Separated | Hazy; Phase Separated |
| pH | 7.4 | 7.2 | 7.2 | 7.3 |

What is claimed is:

1. A process of making a gel laundry and/or pre-treater detergent composition, the process comprising mixing ingredients comprising preparing a main mixture and a gelling post-mix, which comprise in total:

(a) from about 8% to about 35%, by weight of the composition, of a surfactant, selected from the group consisting of anionic, nonionic, cationic, amphoteric surfactants and mixtures thereof;

(b) additional laundry composition ingredient selected from enzyme, builder, fluorescent dye, soil-release polymer, buffering agent, and mixtures thereof;

(c) from about 0.1% to about 5%, by weight of the composition, of a fatty alcohol;

(d) from about 50 to about 90% of water;

wherein (i) the mixing is carried out in at least one in-line static or dynamic mixer; and (ii) the gelling post-mix constitutes from about 1% to about 30% of the composition and comprises the fatty alcohol and wherein said composition comprises 3 to 35% by weight of an anionic surfactant.

2. The process of claim 1 wherein the gelling post-mix is mixed with the main mixture comprising the balance of the ingredients immediately prior to the pumping to a filling station.

3. The process of claim 1 wherein the gelling post-mix further comprises an organic ingredient selected from non-ionic surfactant, organic solvent, and anionic surfactant precursors and mixtures thereof.

4. The process of claim 1 wherein the gelling post-mix further comprises an antioxidant.

5. The process of claim 1 wherein the composition further comprises from about 0.1 to about 6%, by weight of the composition, of a hydrotrope.

* * * * *